United States Patent [19]

Maloney et al.

[11] Patent Number: 4,708,595

[45] Date of Patent: Nov. 24, 1987

[54] INTERMITTENT OIL WELL GAS-LIFT APPARATUS

[75] Inventors: Timothy R. Maloney, Tarzana; David E. Patterson, Canoga Park; Richard J. Aseltine, Rancho Palos Verdes, all of Calif.

[73] Assignee: Chevron Research Company, San Francisco, Calif.

[21] Appl. No.: 640,076

[22] Filed: Aug. 10, 1984

[51] Int. Cl.[4] ..... F04F 1/20; F21B 43/00

[52] U.S. Cl. ..... 417/109; 166/372

[58] Field of Search ..... 166/370, 372, 115, 116, 166/142, 148, 265, 68, 68.5, 105.5; 417/108, 109, 111, 113, 56, 57, 58, 59, 90, 118

[56] References Cited

U.S. PATENT DOCUMENTS

| | | | |
|---|---|---|---|
| 1,798,774 | 3/1931 | Yates | 166/267 |
| 3,215,087 | 11/1965 | McLeod, Jr. | 166/297 |
| 3,232,885 | 2/1966 | Henke | 166/268 |
| 3,814,545 | 6/1974 | Waters | 417/90 |
| 3,941,510 | 3/1976 | Morgan | 417/57 |
| 3,941,511 | 3/1976 | Morgan | 417/57 |
| 3,991,825 | 11/1976 | Morgan | 417/58 X |
| 4,222,440 | 9/1980 | Parker | 166/372 |
| 4,397,612 | 8/1983 | Kalina | 417/108 X |
| 4,545,731 | 10/1985 | Canalizo et al. | 417/90 X |

OTHER PUBLICATIONS

Nind, T. E. W. *Principles of Oil Well Production,* New York, N.Y., McGraw-Hill Book Company, 1981, pp. 219-220.

*Primary Examiner*—Stephen J. Novosad
*Assistant Examiner*—David J. Bagnell
*Attorney, Agent, or Firm*—S. R. La Paglia; E. J. Keeling; E. A. Schaal

[57] ABSTRACT

An intermittent gas-lift apparatus and process of lifting liquids is described. The apparatus includes a chamber on the downhole end of a production tubing in communication with a sidestring tube. The sidestring tube is in communication with the high pressure gas stored within the casing above and below a packer. A valve in the sidestring permits the entrance of a lifting gas into the chamber to lift the liquids flowing therein to the surface. A surface bleed-down system minimizes the pressure in the production tubing. This increases the pressure differential between the formation and the interior of the casing and lifting chamber during the operation of the apparatus. The apparatus and process are suitable for use in many types of wells including wells of great depth and also those containing long hydrocarbon producing zones and/or deviated wells.

10 Claims, 1 Drawing Figure

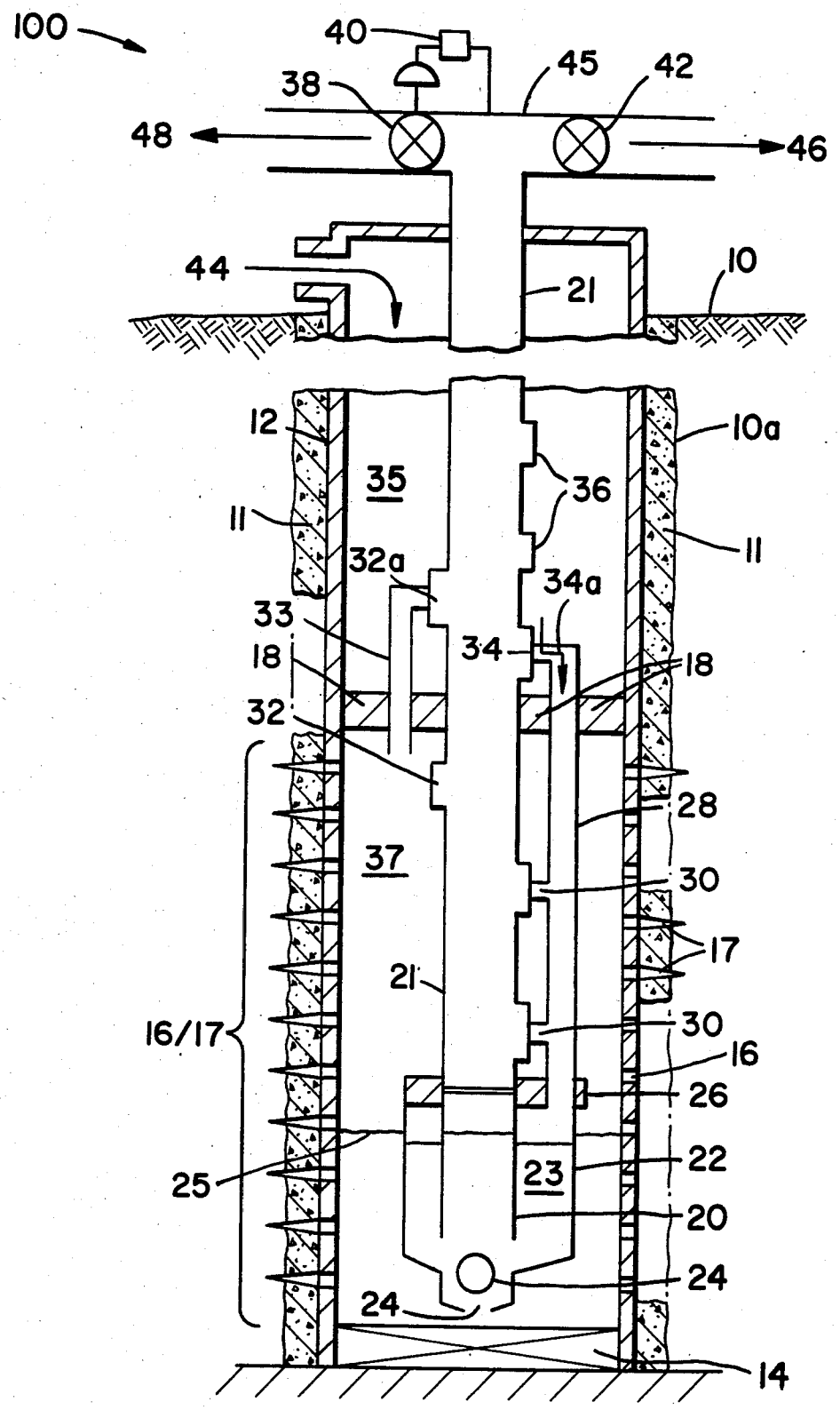
100
40
38
45
42
48
46
44
21
10
12
10a
35
36
11
11
32a
34a
33
34
18
18
32
28
37
30
17
21
16/17
30
16
26
25
22
23
20
24
24
14

INTERMITTENT OIL WELL GAS-LIFT APPARATUS

This invention relates to a gas-lift apparatus. More specifically, this invention relates to an intermittent gas-lift apparatus and the process of lifting liquids from oil wells.

BACKGROUND OF THE INVENTION

When a hydrocarbon containing formation has insufficient pressure to lift liquids to the surface without assistance, alternative methods are required for their recovery.

Conventional gas-lifting or intermittent gas-lifting are suitable techniques for that purpose. Gas-lifting or intermittent gas-lifting operations usually attempt to achieve as low a pressure as possible in the well bore opposite the perforations and in the hydrocarbon producing rock formation adjacent thereto. The flow of fluid into the well bore depends directly on the difference between the formation pressure and the well bore pressure.

Thus, it would be highly desirable to have an apparatus and process for maximizing this pressure difference to increase the production of hydrocarbons from the producing formation. It would be also desirable to have an apparatus and process which is adaptable to wells which are presently configured for gas-lift or intermittent gas-lift operations.

SUMMARY OF THE INVENTION

We have invented an intermittent gas-lift apparatus and process for intermittent gas-lifting of liquids from a producing formation which has the previously recited desirable attributes and other benefits which are readily apparent to the ordinary skilled artisan. The apparatus fits within a well bore casing and includes a large tube having a valve on the downhole end thereof, and sealed to the downhole end of the production tubing by a connector opposite the end containing the valve to form a chamber therebetween. The connector connected to the production tubing further includes a connection for a dip-tube extending into the chamber below the end of the production tube and forming a continuous flow path to the surface of the well from the chamber. A sidestring tube is also connected to the chamber and communicates with the casing above a packer through a valve. The packer isolates the perforations in the casing below the packer from the high pressure gas within the casing above the packer. The valve in the sidestring tube above the packer permits high pressure compressed gas which has entered the casing to pass through the side-string and into the chamber to displace accumulated fluids and lift the fluids to the surface. Commonly used gas-lift unloading valves are also incorporated within the mandrels in the production tubing above the packer and can also be used below the packer by connecting them to the sidestring.

On the surface, a pressure bleed-down valve and a check valve permit the reduction of the pressure in the production tubing and the chamber to the lowest possible pressure. An orifice valve with a back-check is located in a mandrel below the packer in the production tubing. This valve vents the gas trapped in the casing annulus below the packer to the production tubing during the appropriate phase of the intermitting cycle. This reduces the pressure in the area outside the chamber and opposite the perforations.

The process involves venting gas from the production tubing to a low pressure surface gas handling system and venting the casing annulus below the packer to the production tubing while the chamber fills with liquid. Hence, fluids can flow from the formation into the chamber with a minimum amount of pressure against the perforations in the casing. Thereafter, gases injected into the casing and passing through the sidestring tube aoove the packer and down into the chamber lifts the hydrocarbons or other liquids which have entered the chamber to the surface. At the surface the compressed gas is recovered for reinjection and/or sale.

BRIEF DESCRIPTION OF THE FIGURE

The Figure illustrates a cross-sectional view of the intermittent gas-lift apparatus of our invention.

DETAILED DESCRIPTION OF THE INVENTION

The intermittent gas-lift apparatus and process of intermittently lifting liquids from a producing formation will be more clearly illustrated by referring to the Figure. A cross-sectional view of the intermittent gas-lift apparatus is illustrated as 100 in the Figure. The earth 10 is penetrated by a well bore 10*a*. The well bore 10*a* is lined with a casing 12 which is affixed therein with a suitable material, such as cement 11. Although the casing can vary in size, the casing 12 will be described herein with respect to pipe having an outside diameter of about 7 inches. The casing 12 is within the well bore 10*a* and cement 11 is placed between the casing 12 and the well bore 10*a*. The bottom of the casing is fixed in place with a cement plug 14. The perforations 16 in the casing 12 and the perforations 17 through the cement 11 permit the hydrocarbons and/or other fluids and gases to pass from the formation into the interior of the casing 12. Our invention is also suitable for other configurations used for extracting fluids from a formation.

Our apparatus is ideally suited for intermittent gas-lift operations where the producing zones are quite long, i.e., on the order of 1000 feet or more. However, the apparatus 100 is not limited to use in formations having long producing zones. In this illustration, the bottom of the perforations 16/17 is about 6000 feet below the surface. However, this apparatus 100 is not limited to formations of this depth.

In this illustration, the perforations 16/17 will extend through the casing 12 and cement 11 upward about 2000 feet over the entire length of the producing zone. A packer 18 fits within the casing 12 to seal a production tubing 21 therein at the top of the producing zone. With a 7-inch casing, a suitable pipe 22 to form a chamber 23 would have an outside diameter of about 4 inches with a 2" dip-tube 20 within it. The production string 21 is generally 2" or 2 ½" in diameter. Although the exact sizes of casing, tubes and pipes can vary from well to well.

The sidestring pipe 28 starts at the mme mandrel (a side-pocket gas lift mandrel that allows gas to pass through the valve and then into a lower sidetube) 34, passes through the packer 18, passes by the unloading mandrels 30 and through the connector 26, and into the chamber annulus, i.e., the space between the pipe 22 and the dip-tube 20. High pressure gas can pass through the "mme" mandrel 34 as illustrated by 34*a* (which can be a side pocket mandrel pilot valve) to lift the liquids to the surface. The sidestring pipe 28 has an inside diameter of about 1 ¼" or 1 ½". The standing valve 24 is located in a nipple which is threadedly engaged with the pipe 22 which is threadedly engaged to the connector 26. A chamber 23 is formed between the walls of pipe 22 and the standing valve 24 and connector 26. The chamber 23 includes the dip-tube 20. The standing valve 24 usually has a size equivalent to the dip-tube 20 or about 2". Most preferably, the valve 24 is smaller in size than the fittings above it so that it can be serviced while in the casing, i.e., wireline retrievable. For a 4" chamber a connector 26 can be constructed with an outside diameter of about 4.7". The volume of the chamber 23 is a function of the length of the dip-tube/pipe 20/22 combination. The optimum chamber volume 23 is about 5–6 barrels which requires a pipe 22 length of about 400' for a 4" diameter pipe. Of course the chamber volume can be optimized for a particular well.

The production string 21 further includes an orifice valve 32 with a back-check just below the packer 18. The orifice valve 32 permits the escape of gases trapped below the packer 18 and between the casing 12 and the production string 21, i.e., 37, into the production string 21. It opens when the pressure in the casing annulus below the packer 18 is greater than the pressure in the production string 21. Alternatively, the production string 21 can contain a value 32*a* located in the production string 21 above the packer 18 and in communication with the area 37 below the packer 18 through pipe 33. The production string 21 further includes unloading valves 36 above the packer 18 and unloading valves 30 below the packer 18. The unloading valves 36 and 30 allow gas to enter the production string 21 from either the casing annulus 35 or from the sidestring 28. The purpose of the unloading valves is to lift liquid from the well only after it has been shut-in for a period of time. The unloading valves 36 and 30 are set to open and close at pressures above the set pressures of the operating valve in the "mme" mandrel 34. Therefore, the unloading valves do not interfere with the intermitting cycles of the well. Suitable sources for unloading valves 30 and 36, orifice valve 32 or 32*a*, and "mme" mandrel 34 are products of the Teledyne-Merla, corporation of Dallas, Tex.

The spacing of the unloading valves 30 and 36 are configured by methods known in the art of conventional gas-lift design.

On the surface, the production string 21 is in communication with the flowline 45 which passes through the check-valve 42 and sends the fluids toward the separator 46. Alternatively, the fluid can be directed toward a low pressure gas collection system 48 via an additional flowline which passes through a motor controlled valve 38. A pressure operated pilot 40 senses pressure at the top of the production string 21 and controls the opening and closing of the motor valve 38.

Having described the apparatus, the process of recovering hydrocarbons will be more specifically described with reference to the Figure. Initially, valves 32 ahd 38 are opened so as to reduce the gas pressure in the production string 21 and in casing annulus 37. The large pressure drop from the formation to within the casing forces fluids through the perforations 16/17 and up into the chamber/dip-tube volume 23 through the standing valve 24. The filling of the chamber can take typically from about 10 minutes to one hour depending on the formation and the length of the chamber.

When the chamber/dip-tube volume 23 is filled, as illustrated by fluid level 25, a compressed gas, such as methane, or nitrogen, which is stored at high pressures in the casing annulus 35 above the packer 18 is sent through the operating valve in the "mme" mandrel 34 illustrated as path 34*a*, down the sidestring 28, down the chamber annulus 23, up the dip-tube 20, up the production tubing 21, to the surface flow lines 45. During this lifting cycle the standing valve 24 and the back-check in the orifice valve 32 are forced closed by the high pressures in the tubing, thus retaining all the liquid within tubing 21. The liquid slug is pushed to the surface by the high pressure gas at a speed of approximately 1000 ft./minute. When the liquid slug reaches the surface, the wellhead pressure rises rapidly, triggering the pressure operated pilot 40 to close the motor valve 38, thus sending the liquid toward the separator 46. After the liquid clears the surface, the operating valve in the "mme" mandrel 34 closes and the gas in the sidestring, chamber, dip-tube and production tubing begin to bleed down to a pre-set pressure (can be 100 psig). As the wellhead pressure decreases to a pre-set pressure, the pressure operated pilot 40 triggers the motor valve 38 to open and the tubing pressure is pulled down even further (can be as low as 10 psig). Also, as the tubing pressure declines, the orifice valve 32 with the back-check opens allowing gas trapped below the packer 18 in space 37 to be vented and the ball in the standing valve 24 comes off seat allowing fluid to enter the chamber 23. High pressure gas continually enters the casing annulus 35 at choke 44. The intermitting cycle frequency is controlled by the valve 34. An additional benefit of our apparatus is that all the subsurface valves, i.e., unloading 30/36, operating 34, orifice valve 32 and standing valve 24 are wireline retrievable.

The time to perform a lifting operation is a function of the distance the producing formation is below the surface. For a formation with a chamber at a depth of about 6000 feet, a suitable lifting time is on the order of about 5 or 6 minutes. The apparatus described above has been used in wells having producing zones as thick as 2000 feet and located between 4000 and 6000 below the surface. Although it is not limited to such formations and can find use in any intermittent gas-lift operation. The apparatus and process of our invention resulted in a gross fluid production increase of 67% over a continuous gas-lift operation with an additional increase of about 5% during the operation of the surface low pressure bleed-down system.

The apparatus has been described with respect to particularly preferred embodiments. Modifications which would be obvious to one of ordinary skill in the art, such as increasing the rate of bleed-down or reconfiguring the spacing between valves or volume within the chamber, and the like, are contemplated to be within the scope of the invention.

What is claimed is:

1. An intermittent gas-lift apparatus comprising:

a production tube located within a well bore casing which penetrates a formation;

a packer to seal said production tube within said casing above perforations within said casing, said perforations provide fluid communication between the formation and the interior of the casing;

a connector connected to the end of said production tube which extends below said packer;

a dip-tube connected to said connector opposite to a side of said connector connected to said production tube, said production tube and said dip-tube provide a fluid flow path to the surface of the well;

a pipe surrounding said dip-tube and connected to said connector, said pipe extends below the end of said dip-tube;

a valve connected to said pipe on an end opposite to the end connected to said connector and forming a chamber therebetween;

a sidestring pipe within said casing and connected to said chamber, said production tube above/below said packer, said sidestring tube in communication with said casing above said packer through a valve;

a valve in said production tube below said packer to provide communication between said casing below said packer and the surface through said production tube;

unloading valves within said production tube above said packer to enable fluid/gas flow into the production tube above said packer;

a valve at the surface of said casing to introduce a compressed gas into said casing;

a bleed-down pilot operated pressure valve at the surface of the well to minimize the pressure within said production tubing and said chamber; and a check valve means to separate produced fluids from the apparatus without the back flow into said production tube.

2. The apparatus according to claim 1 wherein said casing is cemented into said formation adjacent to said standing valve below the base of said chamber.

3. The apparatus according to claim 2 wherein the perforations are along a length of from about 25 feet to about 2500 feet of said casing.

4. An intermittent gas-lift apparatus for lifting liquids, said apparatus comprising:

a production tube positioned within a casing wherein said casing has perforations adjacent a producing formation to provide a path of fluid communication between the formation and the interior of the casing;

means for sealing the production tube within the casing above said perforations therein;

a chamber connected to the downhole end of said production tube;

a valve for controlling the flow of fluid into the chamber connected to the opposite side of said chamber connected to said production tube;

means for connecting said chamber with said production tube, above and below said means for sealing said production tube within said casing;

means for introducing a gas into the casing;

means for injecting said gas into said chamber within said means for connecting and above said means for sealing;

means for passing gas, located within said casing below said means for sealing;

means for reducing the pressure within said casing, said production tube and said chamber at the surface of said well so as to maximize the pressure drop between said formation and said chamber; and means for separating the hydrocarbons produced therefrom at the surface of said well.

5. The apparatus according to claim 4 wherein said means for connecting said chamber with said production tube above and below said means for sealing is a sidestring tube.

6. The apparatus according to claim 5 wherein said means for sealing said production tube within the casing above the perforations in said casing is a packer.

7. The apparatus according to claim 6 wherein said means for purging gas from said casing into said production tube below said packer is selected from the group consisting of a valve located within said production tube below said packer, a valve located within said production tube above said packer and in communication through said casing below said packer through a pipe passing therethrough or a valve within said packer and connected to said production tube.

8. The apparatus according to claim 7 wherein said means for injecting gas into said chamber through said sidestring tube above said packer is a side pocket mandrel pilot valve.

9. The apparatus according to claim 8 wherein said means for reducing pressure are surface bleed-down valves.

10. The apparatus according to claim 9 which further includes a check valve to separate produced fluids in the apparatus without the back flow into said production tube.

* * * * *